US005446340A

United States Patent [19]

Parillo et al.

[11] Patent Number: 5,446,340

[45] Date of Patent: Aug. 29, 1995

[54] DISCHARGE LAMP HAVING A LAMP ENVELOPE WITH A TEXTURED SEALED REGION AND METHOD OF MAKING SAME

[75] Inventors: Edward V. Parillo, Highland Heights; Erwin G. Steinbrenner, Parma Heights; Alexander L. Guba, South Euclid, all of Ohio

[73] Assignee: General Electric Company, Schenectaday, N.Y.

[21] Appl. No.: 130,817

[22] Filed: Oct. 4, 1993

[51] Int. Cl.[6] ..... H01J 17/16

[52] U.S. Cl. ..... 313/493; 362/260

[58] Field of Search ..... 313/493, 573, 577, 634, 313/642, 318; 362/260; 220/2.1 R

[56] References Cited

U.S. PATENT DOCUMENTS

| | | | |
|---|---|---|---|
| 4,721,876 | 1/1988 | White et al. | 313/634 |
| 5,055,735 | 10/1991 | DeJong et al. | 313/573 |
| 5,173,637 | 12/1992 | Sica | 313/493 |

*Primary Examiner*—Stephen Brinich,
*Attorney, Agent, or Firm*—George E. Hawranko; Stanley C. Corwin

[57] ABSTRACT

A discharge lamp having a lamp envelope with at least one sealed end which is disposed in the base member of the discharge lamp includes an excitation arrangement capable to emit light output upon sufficient energization, an energization arrangement disposed in the base member sufficient to excite the lamp envelope. The sealed end of the lamp envelope has a roughened texture disposed around a substantial portion thereof. The texturized region is grit blasted and structurally weaker than the remaining portion of the lamp envelope. At least one sealed end of the lamp envelope is texturized and is effective so as to: shut down the discharge lamp upon the possible occurrence of a high temperature condition and, upon shut down, substantially maintain the envelope fill material within the lamp envelope and base member.

11 Claims, 3 Drawing Sheets

DISCHARGE LAMP HAVING A LAMP ENVELOPE WITH A TEXTURED SEALED REGION AND METHOD OF MAKING SAME

FIELD OF THE INVENTION

This invention relates to a discharge lamp having a lamp envelope with a textured seal region. More particularly, this invention relates to such a lamp envelope as exhibits a textured sealed region which controls lamp failure in the event of an excessive temperature condition while benefiting the environment by allowing containment of the envelope fill within the base member of the discharge lamp under certain excessive temperature conditions.

BACKGROUND OF THE INVENTION

The designs of compact fluorescent lamps have as their principle aim the obtainment of significant energy savings over the use of incandescent lamps while attaining a comparable level of light output. It is also a significant advantage that such compact fluorescent lamps have a considerably longer life than a conventional incandescent lamp.

With most of such fluorescent or low pressure discharge lamp devices, it is necessary to provide a ballasting circuit to perform the function of conditioning the current signal used to drive the discharge lamp. An example of a compact fluorescent lamp utilizing a typical ballasting circuit can be found in U.S. Pat. No. 4,481,442 issued on Nov. 6, 1984, to Wolfgang Albrecht et al. It will be noted that the compact fluorescent lamp described in this patent consists of a bent discharge envelope which contains mercury gas. Furthermore, it will be noted that the ballasting circuit described in this patent relies on an electromagnetic type of ballasting; that is, one that requires the use of a magnetic core transformer to condition the current signal. Because such a ballasting arrangement operates at a power line current frequency of 60 hz which can result in lamp flicker, it has been determined that an electronic high frequency ballast that would eliminate the occurrence of lamp flicker or light variation, would be preferable. An example of a high frequency electronic ballast arrangement for a gas discharge lamp can be found in U.S. patent application Ser. No. 08/020,275 filed on Feb. 18, 1993, by Louis R. Nerone, now U.S. Pat. No. 5,341,068, issued Aug. 23, 1994.

It will be noted that the ballast arrangement is typically housed in a base member, and that such base member can have an upper cap portion which surrounds pinched seals of the outer ends of the tubular discharge envelope. Though this arrangement has proven to be simple and reliable when used with lower frequency circuits, it may be necessary to utilize additional housing/lamp envelope configurations when a high frequency electronic ballast circuit is utilized. For instance, with the higher frequency electronic ballast arrangement, dynamic losses can potentially occur wherein the term "dynamic losses" can be considered as that amount of energy in the circuit that is not converted to light by way of the energization of the lamp but is otherwise lost in the form of heat dissipated. Therefore, in order to prevent a thermal runaway condition or a condition where the discharge envelope operates at a higher temperature than would be intended it would be advantageous if operating temperature conditions could be managed so as to avoid damage to the lamp or lamp base. One way to avoid overheating conditions would be to increase the efficiency of the ballast circuit so as to insure the maximum conversion of input energy to light output. Such a high efficiency ballast circuit could be designed to operate with the lamp and base configuration of the typical compact fluorescent lamp, however, the increased cost and complexity could make such a lamp commercially undesirable. Alternatively, a heat sink arrangement may be developed which channels heat to a location where it could be more readily dissipated. With this alternative however, it must be understood that the housing base is constructed of a molded plastic material that could not accommodate dissipation of a significant amount of heat and moreover, must be adaptable to both a base-up and a base-down orientation in a light fixture thereby further complicating any type of heat sinking arrangement in the housing base.

It has been observed that the occurrence of an excessive heat condition in the lamp ballast and base housing configuration will occur only in the most extreme circumstances (i.e. excessively high line voltage) and/or under conditions which can be best described as misuse (i.e. improperly ventilated fixtures). Therefore, another alternative to adding components and therefore cost to the overall product, given the small likelihood of an excessive heat condition occurring, would be the provision of a controlled failure attribute. It would therefore be desirable to provide a mechanism that in the event of the occurrence of thermal conditions beyond a predetermined level, a controlled lamp failure would occur.

In addition, upon an unlikely excessive thermal condition occurring, the base member and/or lamp envelope could have potentially been damaged. However, as a result of the controlled failure the base housing member would be left undamaged, and upon the occurrence of significant lamp envelope violation in the controlled region, the fill could be substantially contained within the base member. It would therefore be desirable to maintain the envelope fill in the base member upon the occurrence of thermal conditions beyond a predetermined level.

Accordingly, it is an object of the present invention to provide a pinch seal region employing a conditioned glass envelope end to efficiently shut down the lamp prior to an excessively high temperature condition.

It is a further object of the present invention to provide an environmentally beneficial discharge lamp designed to maintain the envelope fill materials in the base member upon shut down.

SUMMARY OF THE INVENTION

The present invention provides a discharge lamp comprising a compact fluorescent lamp having a multi-axis lamp envelope which has at least one sealed end having associated therewith, an improved textured pinch-sealed region. This improved pinch-sealed region allows for the use of high frequency electronic ballasts as the energizing means for compact fluorescent lamps thus preventing lamp flicker or light variation as the textured glass increases the emissivity of the sealed region keeping the lamp envelope cooler. The improved pinch-sealed region of the present invention also allows for the shut down of the lamp should the lamp temperature exceed a predetermined level. Moreover, the improved pinch-sealed region achieves this and also maintains the envelope fill material within the base member upon significant lamp violation occurring during shut down providing an environmentally sound discharge lamp.

In accordance with the principles of the present invention, there is provided a discharge lamp which includes a lamp envelope having at least one sealed end which is disposed in the base member of the discharge lamp. The discharge lamp also includes excitation means disposed in the lamp envelope capable to emit light output upon sufficient energization. The energization means required to excite the lamp envelope is disposed in the base member. The sealed end of the lamp envelope has a roughened texture disposed around a substantial portion thereof. The roughened texture of the sealed region is structurally weaker than the remaining portion of the lamp envelope. The roughened texture seal region is effective so as to shut down the discharge lamp upon the possible occurrence of a high temperature condition above a predetermined level. The roughened texture seal region by being the point at which the discharge chamber is compromised and being disposed within the space of the base member, is further effective in maintaining the envelope fill within the base member upon shut down.

BRIEF DESCRIPTION OF THE DRAWINGS

In the following detailed description, reference will be made to the attached drawings in which.

DETAILED DESCRIPTION OF THE DRAWINGS

Figure 1:
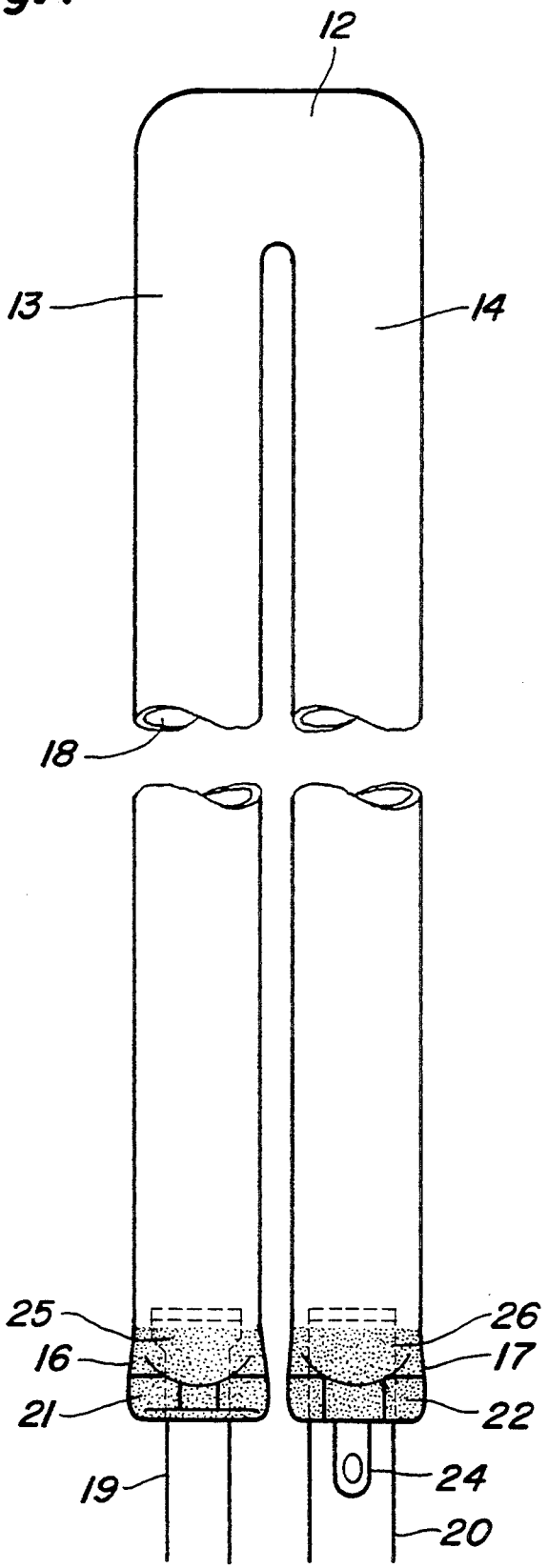
FIG. 1 is a side view of a lamp envelope with base end removed.

As seen in FIG. 1, a lamp envelope 10 is illustrated having a transverse tube section 12 with two longitudinal tube sections 13, 14 aligned parallel to one another extending from the U-bend portion 12 to the sealed end portions 16, 17. Of course it should be understood that the seal configuration of the present invention will be equally effective for any number of axis configurations. The inner surface of the lamp envelope 10 is provided with a phosphor coating 18 in the conventional manner. Conventional electrode and lead-wire assemblies 19, 20 are sealed in the two ends 16, 17 of the lamp envelope 10 by means of the pinch seals 21, 22. One of the sealed ends is provided with a tipped-off exhaust tube 24. As a filling, the lamp envelope 10 contains mercury and argon as a starting gas. The pinch sealed regions 21, 22 of the lamp envelope 10 are grit-blasted using a non-silica grit which provides a roughened texture 25, 26 on a substantial portion of the pinch seal region 16, 17. The roughened texture of this seal region is effective so as to render this portion of the lamp envelope 10 structurally weaker than the remaining portions of the lamp envelope 10.

Figure 2:
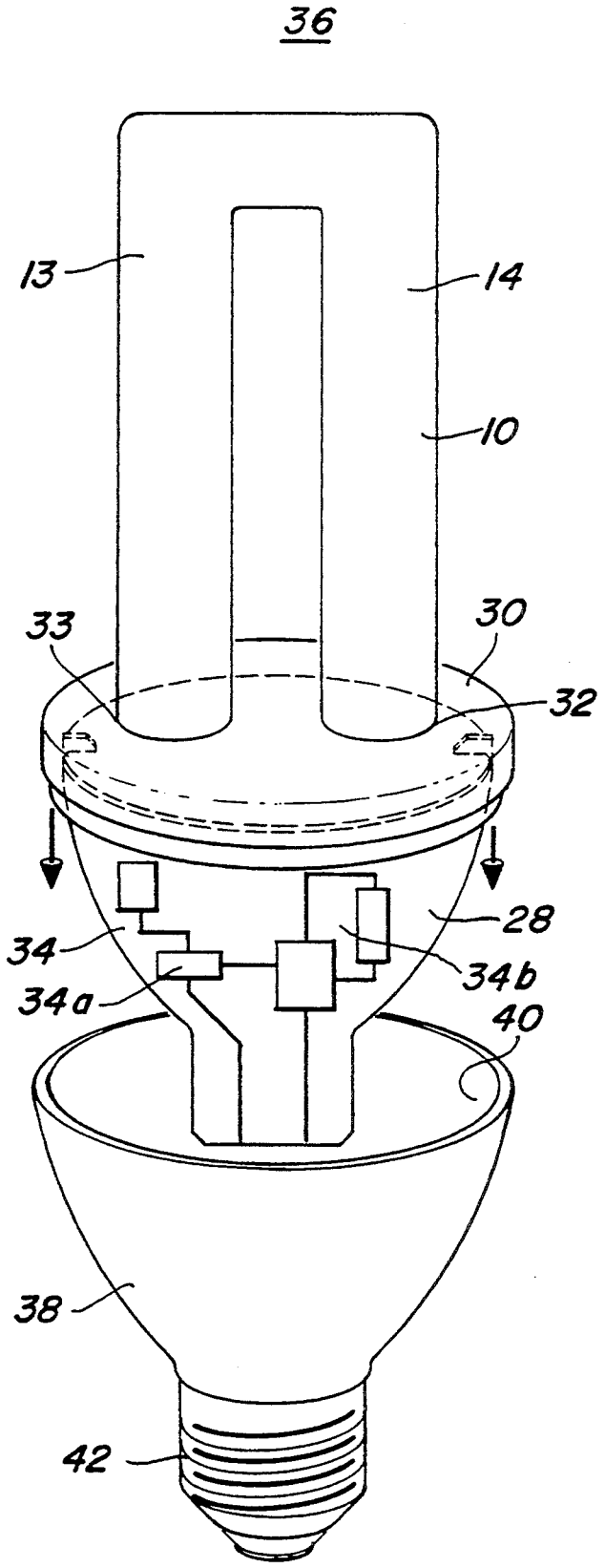
FIG. 2 is a side view in section of the discharge lamp with base end attached.
Figure 3:
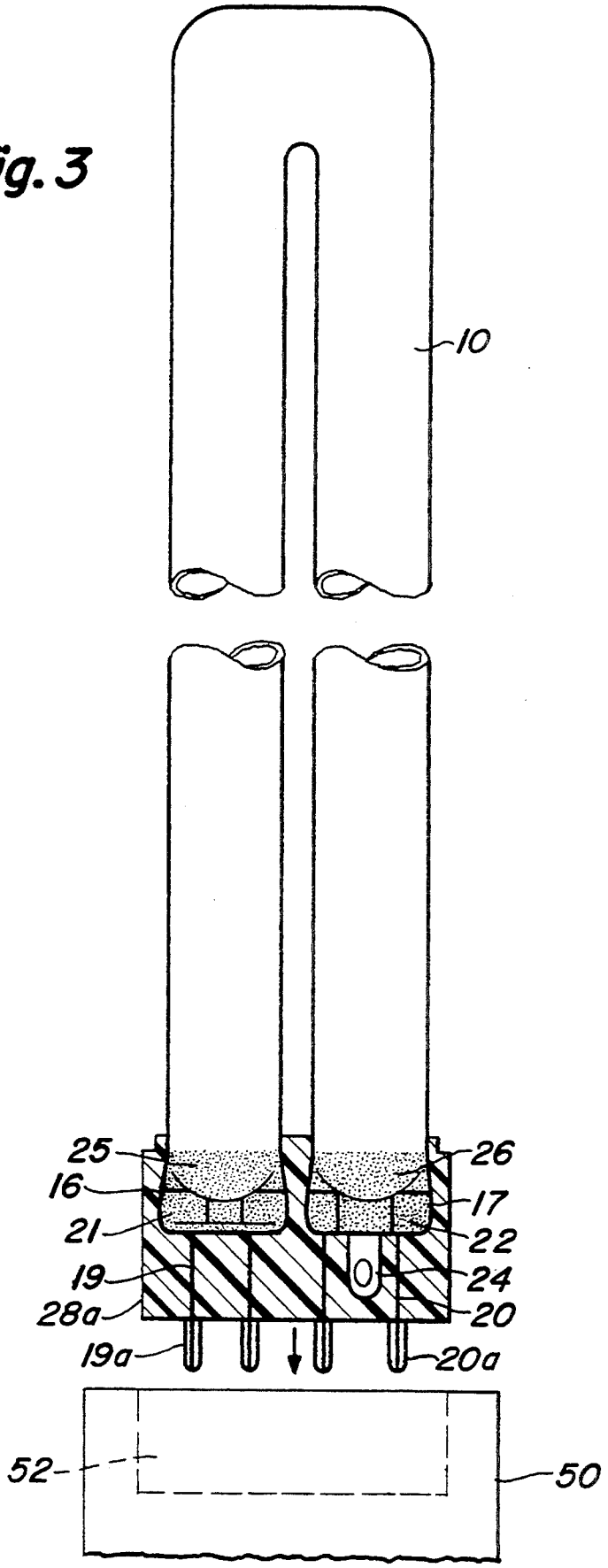
FIG. 3 is a side view in section of the discharge lamp with alternative base end.

As seen in FIG. 2, the sealed ends 16, 17 of the lamp envelope 10 are housed in a synthetic base member 28. The top face 30 of the base member 28 receives the envelope tubes 13, 14 through an opening 32 with the lamp envelope 10 stabilized in the base member by cement bonds 33. The electrode arrangements 19, 20 of the sealed ends 16, 17 are affixed to the energization source 34 housed in the base member 28. The energization source 34 is typically a high frequency electronic ballast arrangement as described in previously referenced U.S. patent application Ser. No. 08/020,275 shown representationally as including circuit component **34*a* disposed on a printed circuit board 34*b*. In the preferred embodiment of FIG. 2, the synthetic base member 28 is housed in a socket adapter member 38 having an opening at one end 40 to receive the base member 28 and an ordinary screw base 42 at the opposite end to allow the discharge lamp to be used in standard lamp sockets. In the preferred embodiment, the synthetic base member 28 is housed in a socket adapter member 38 having an opening at one end 40 to receive the base member 28 and an ordinary screw base 42 at the opposite end to allow the discharge lamp to be used in standard lamp sockets. Of course, an electromagnetic ballast arrangement or similar ballast arrangements as are common in the field may also be used as energization sources. One such alternative arrangement, as seen in FIG. 3, utilizes a conventional fixture 50, housing an energization source having a socket adapter 52 receiving the base member 28*a* and the lead wire assemblies 19, 20 by means of prongs 19*a*, 20*a* to energize the lamp envelope 10**. Fluorescent lamps configured for fixtures having a socket adapter disposed therein, are conventional in the art.

In a typical commercial application of the discharge lamp 36, the ballast arrangement utilizes an AC energy source to excite the electrodes 19, 20 resulting in the thermalization of the envelope fill to ultraviolet radiation which is converted by the phosphor coating 18 to visible light. The prior art discharge lamps were effective in utilizing low power line frequencies of 60 Hz to achieve light output. The preferred embodiment utilizing the high frequency ballast arrangement operates at a resonant frequency of between 40–200 kHz, necessary to eliminate lamp flicker and lamp variation experienced at lower current frequency operations.

Referring now to FIG. 2, it can be seen that a discharge lamp 36 is proposed which utilizes a roughened pinch sealed end region 25, 26 which is structurally flawed relative to the remainder of the lamp envelope 10. By such selective placement of "flaws" on a portion of the lamp envelope that is not visible when the lamp is in operation, not only is an overheating condition avoided, but the present invention also achieves the benefits of avoiding a reduction in light output and, when a controlled failure in this region does occur, of substantially containing any loose material within the base member 28. In order to control the potential damage resulting from a potential excessive thermal condition, the roughened pinch sealed regions 25, 26 of the proposed discharge lamp condition the lamp envelope 10 to fail with failure initiating on the outer roughened pinch seal regions **25*a*, 26*a* and progressing inward resulting in an automatic shut down of the discharge lamp leaving the base member 28 undamaged. Additionally, because the controlled automatic shut down leaves the base member undamaged, it can be appreciated that the envelope fill material can be maintained within the base member 28 and/or lamp envelope 10** subsequent to shut down thus providing environmental benefits.

Although the hereinabove described embodiment of the invention constitutes the preferred embodiment, it should be understood that modifications can be made thereto without departing from the scope of the invention as set forth in the appended claims.

What is claimed is:

1. A discharge lamp comprising:

a lamp envelope having at least one sealed end;

a base in which said at least one sealed end is disposed;

excitation means disposed in said lamp envelope and operable so as to emit light output when energized; and wherein said sealed end of said lamp envelope has a roughened texture disposed around a substantial portion thereof, said roughened sealed end being selectively structurally flawed by said roughened texture relative to the remaining portion of said lamp envelope so that upon the occurrence of a temperature condition in excess of a predetermined value, said roughened sealed end fails in a controlled manner.

2. The discharge lamp as set forth in claim 1 wherein the discharge lamp is a compact fluorescent lamp and further comprises means for energizing said excitation means, said energizing means being disposed in said base member.

3. The discharge lamp as set forth in claim 1 wherein said lamp envelope and said base member are configured so as to be insertable in a fixture having a socket adapter associated therewith.

4. The discharge lamp as set forth in claim 1 wherein the lamp envelope is a multi-axis fluorescent tube having at least one bent region formed therein.

5. The discharge lamp as set forth in claim 1 wherein the excitation means are a mercury and gas fill.

6. The discharge lamp as set forth in claim 1 further comprising means for energizing said excitation means, wherein said energizing means is a high frequency electronic ballast.

7. The discharge lamp as set forth in claim 1 wherein the roughened texture of said sealed end is a plurality of pock marks.

8. The discharge lamp of claim 1 wherein the controlled failure is a breakage of said lamp envelope at said roughened sealed end.

9. A method of manufacturing a discharge lamp having a lamp envelope connected to a base housing member, comprising the steps of in claim 1 comprising the steps of:

blowing gas into the lamp envelope through the tube ends to effect a blow-molding step;

applying a phosphor coating interiorly within the lamp envelope;

inserting an energizing system into the base housing member;

heating the lamp envelope ends to softening temperature and subsequent pinch-sealing of the ends about electrode members which extend into the base housing member;

evacuating, flushing and filling the lamp envelope; and grit-blasting pinch-sealed portions of the tube ends until achieving a roughened texture.

10. A method according to claim 9 wherein the inserted energizing system is a high frequency electronic ballast.

11. A method according to claim 9 wherein said grit blasting step indents a plurality of pock marks using a non-silica grit.

* * * * *